US011606974B2

(12) United States Patent
Scatterday

(10) Patent No.: US 11,606,974 B2
(45) Date of Patent: Mar. 21, 2023

(54) VAPE CARTRIDGE ASSEMBLY

(71) Applicant: Mark Scatterday, Scottsdale, AZ (US)

(72) Inventor: Mark Scatterday, Scottsdale, AZ (US)

(73) Assignee: Jupiter Research, LLC, Scottsdale, AZ (US)

( * ) Notice: Subject to any disclaimer, the term of this patent is extended or adjusted under 35 U.S.C. 154(b) by 378 days.

(21) Appl. No.: 16/869,337

(22) Filed: May 7, 2020

(65) Prior Publication Data

US 2020/0352236 A1 Nov. 12, 2020

Related U.S. Application Data

(60) Provisional application No. 62/844,500, filed on May 7, 2019.

(51) Int. Cl.
*A24F 40/42* (2020.01)

(52) U.S. Cl.
CPC ..... *A24F 40/42* (2020.01)

(58) Field of Classification Search
CPC ..... A24F 40/10; A24F 40/42
See application file for complete search history.

(56) References Cited

U.S. PATENT DOCUMENTS

| | | | | |
|---|---|---|---|---|
| 10,327,476 | B2 * | 6/2019 | Lin | A24F 40/40 |
| 2014/0202474 | A1 * | 7/2014 | Peleg | A24F 40/80 131/328 |
| 2015/0245669 | A1 | 3/2015 | Cadieux et al. | |
| 2017/0064997 | A1 * | 3/2017 | Murison | H02J 7/0044 |
| 2017/0258134 | A1 | 9/2017 | Kane | |
| 2018/0140005 | A1 * | 5/2018 | Lin | H05B 3/44 |
| 2018/0235277 | A1 * | 8/2018 | Lin | H05B 3/46 |
| 2021/0107710 | A1 * | 4/2021 | Biel | B65D 71/502 |

FOREIGN PATENT DOCUMENTS

| | | |
|---|---|---|
| KR | 20140072221 | * 10/2014 |
| WO | 20180172765 | 9/2018 |

* cited by examiner

*Primary Examiner* — Jean F Duverne
(74) *Attorney, Agent, or Firm* — Schmeiser, Olsen & Watts LLP

(57) ABSTRACT

A vape cartridge assembly is provided. The vape cartridge assembly may include a monolithic cartridge body with an inner passage and a connector coupled to an end of the cartridge for connecting to a power source. The assembly may also include an atomizer within an atomizer shell, the atomizer shell comprising a vapor tube, the atomizer shell coupled to the connector within the inner passage of the cartridge body. The assembly may further include a cartridge seal coupled to the vapor tube of the atomizer shell within the inner passage of the cartridge body to form a fluid reservoir on one side of the cartridge seal and a mouthpiece on the opposite side of the cartridge seal.

15 Claims, 6 Drawing Sheets

VAPE CARTRIDGE ASSEMBLY

CROSS REFERENCE TO RELATED APPLICATION[S]

This application claims priority to U.S. Provisional Patent Application Ser. No. 62/844,500, filed May 7, 2019, the disclosure of which is hereby incorporated entirely herein by reference.

BACKGROUND OF THE INVENTION

Technical Field

This invention relates generally to cartridge for a vaping device and more particularly to a vape cartridge assembly that includes a monolithic body that functions as both a fluid tank and a cartridge mouthpiece.

State of the Art

The use of vaping devices is increasing throughout the country. These devices have numerous purposes and enable the user to select from a wide variety of fluids with different ingredients and concentrations. As various state laws make it legal to use cannabis, either recreationally or for medical purposes vape devices are often used for administering. Those that use vape devices, particularly those that are using them for medical purposes may like the form of smoking but dislike what it visually displays to others around them and they may dislike the smell that is a byproduct of burning the ingredients. Additionally, some consumers may not be medically capable of inhalation of smoke from combusted ingredients, where vaporization can provide such users with an acceptable alternative consumption method. There are several components that form a vaping device and many of them are small and may be difficult to use.

Accordingly, what is needed is a monolithic body that functions as both a fluid tank and a cartridge mouthpiece.

SUMMARY OF THE INVENTION

The present invention relates to a vape cartridge assembly that comprises a monolithic body that functions as both a fluid tank and a cartridge mouthpiece.

An embodiment includes a vape cartridge assembly comprising: a monolithic cartridge body with an inner passage; a connector coupled to an end of the cartridge body for connecting to a power source; an atomizer within an inner volume of an atomizer shell, the atomizer shell comprising a vapor tube wherein the atomizer shell is coupled to the connector within the inner passage of the cartridge body; and a cartridge seal coupled to the vapor tube of the atomizer shell within the inner passage of the cartridge body to form a fluid reservoir on one side of the cartridge seal and a mouthpiece on the opposite side of the cartridge seal.

The reservoir may be bound by the cartridge seal on one end, the connector on the other end, the atomizer shell with vapor tube in an interior and the cartridge body on the exterior.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
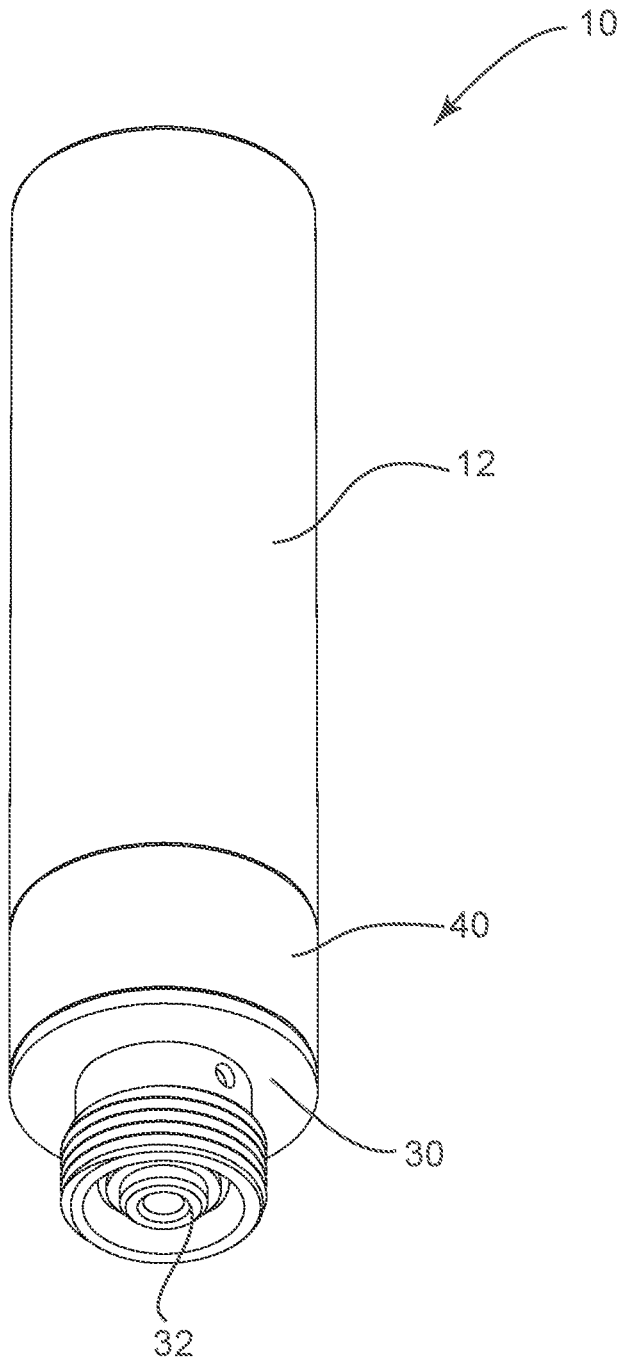
FIG. 1 is a perspective view of a vape cartridge in accordance with an embodiment.
Figure 2:
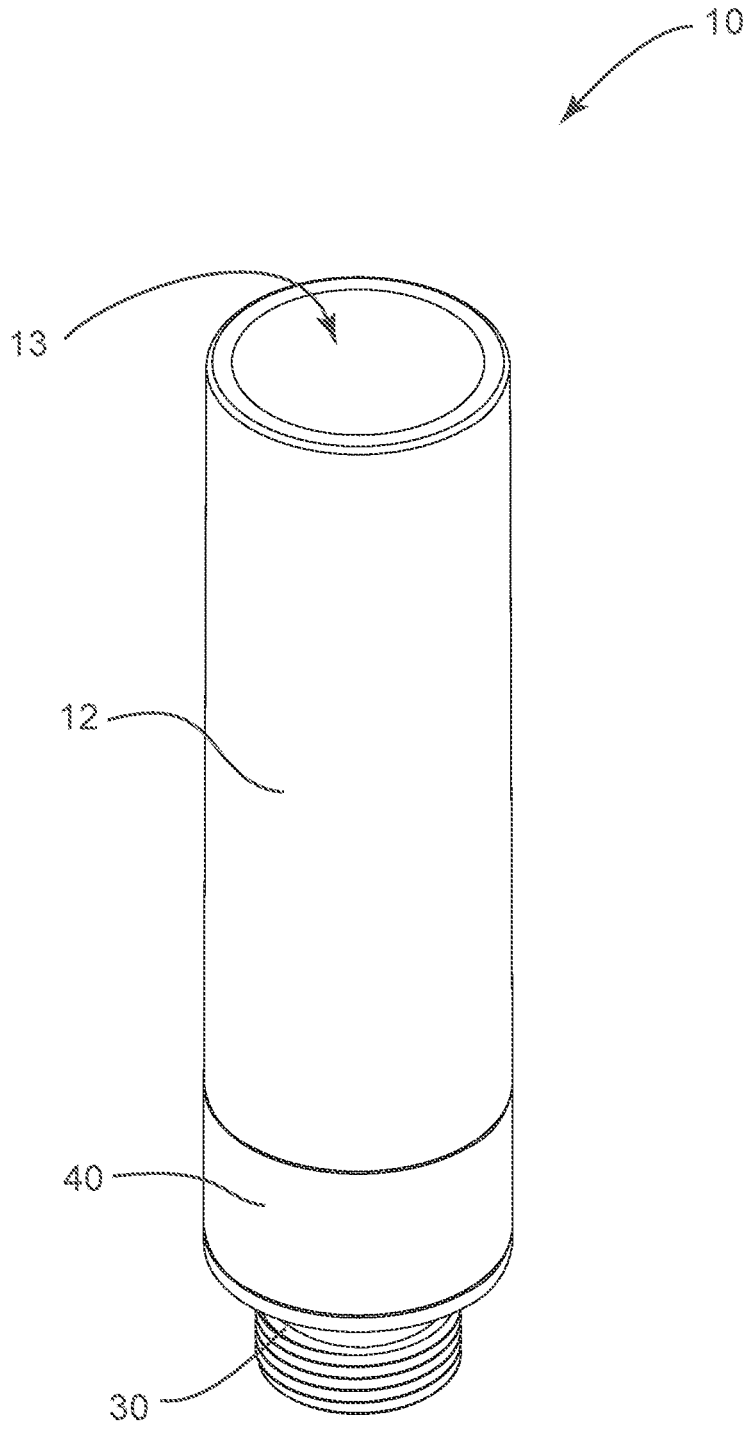
FIG. 2 is another perspective view of a vape cartridge in accordance with an embodiment.
Figure 3:
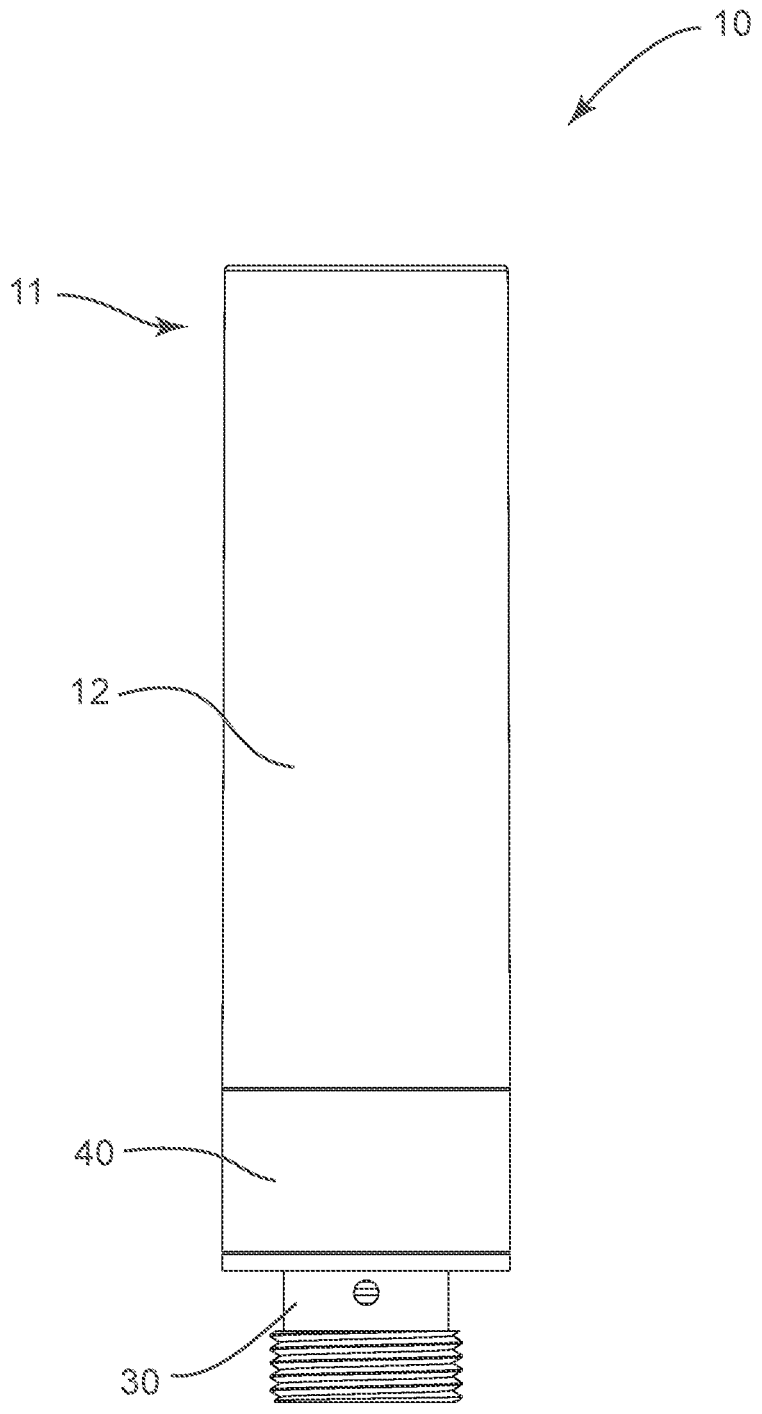
FIG. 3 is a side view of a vape cartridge in accordance with an embodiment.
Figure 4:
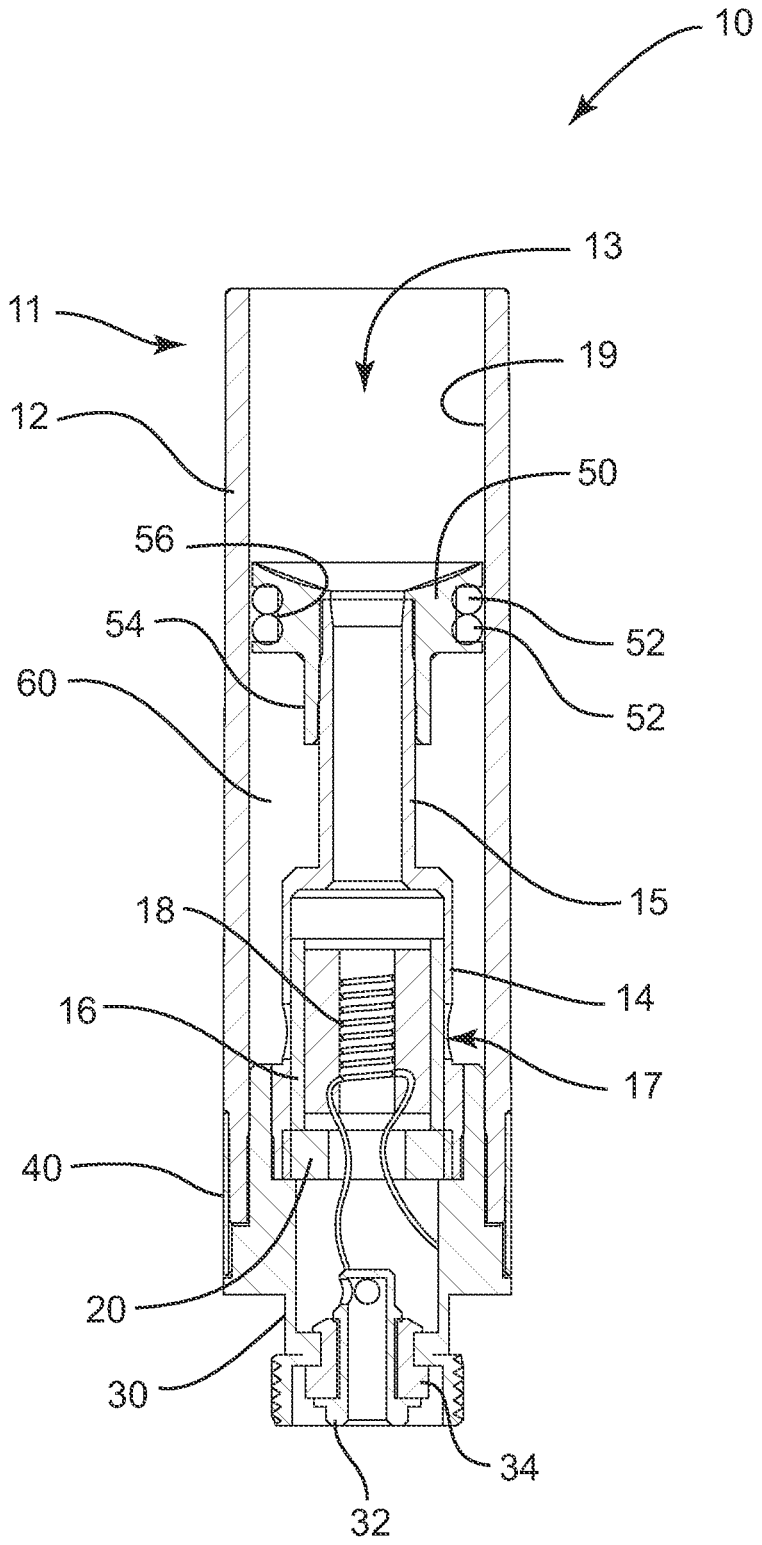
FIG. 4 is a section view of a vape cartridge in accordance with an embodiment taken along line 4-4 of FIG. 3.
Figure 5:
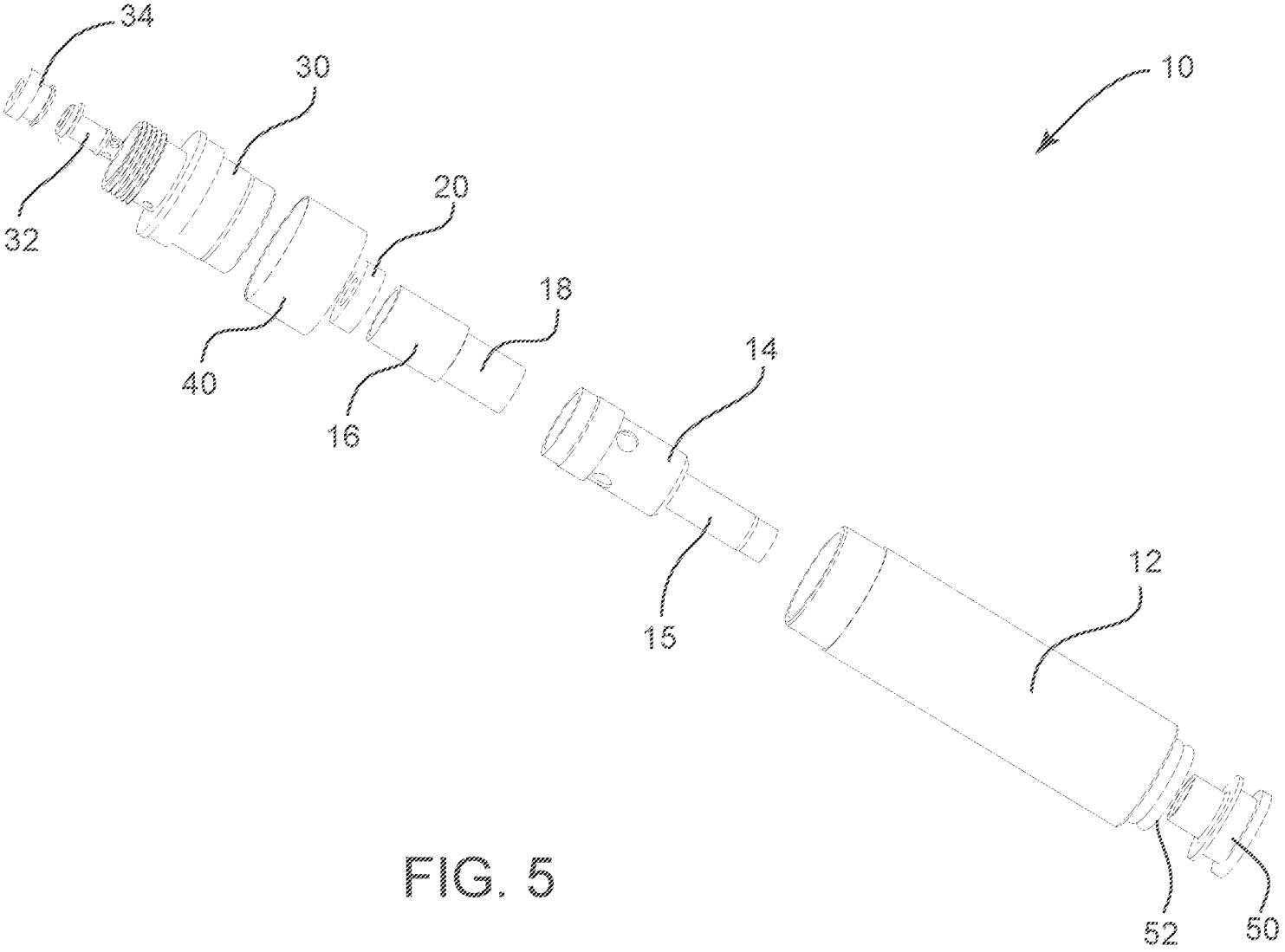
FIG. 5 is an exploded view of a vape cartridge in accordance with an embodiment.

As discussed above, embodiments of the present invention relate to a vape cartridge assembly that comprises a monolithic body that functions as both a fluid tank and a cartridge mouthpiece.

Embodiments of the cartridge assembly incorporate a monolithic cartridge body that will function as both the fluid tank or reservoir and the cartridge mouthpiece. The cartridge body may extend past the airway tube (vapor tube) and protrude from an adaptive insert that is a cartridge seal a predetermined distance, such as but not limited to approximately 10 mm.

The adaptive insert or cartridge seal will be used to seal the cartridge and contain the fluid. The cartridge seal may be a cylindrical insert that combines with one or more silicone O-ring(s) to seal the cartridge when fastened. A guide post or protrusion feature will protrude from the cartridge seal bottom to assist with alignment and ensure a proper seal. The cartridge seal will fasten to the airway vapor tube with threads or a press-fit design. A rounded or tapered design feature will be used on the top of the cartridge seal which will divert accumulated condensation to the airway in order to keep the mouthpiece clean and clear of residue.

The combination of these components and features will yield a sleek, elegant cartridge design that provides a seamless transition from fluid tank to mouthpiece. Ultimately, the vape cartridge assembly depicted and described in this disclosure will provide a modern look and feel while making the cartridge more compact and reducing the build cost. Further, vape cartridge assembly will be adaptable to both Glass and Plastic (such as, but not limited to ETP) monolithic cartridge body materials.

Referring to the drawings, FIGS. 1-5 depict an embodiment of a vape cartridge assembly 10. The assembly vape cartridge assembly 10 may include a cartridge body 12 with an inner passage or bore 13, an atomizer shell 14 with vapor tube 15, a cotton or wick 16, a coil 18 (in embodiments, the atomizer includes the coil 18 that is embedded in the wick 16 and a cotton/cellulose is wrapped around the atomizer for fluid control), a drip catcher 20, a connector 30, a contact pin 32, a contact pin seal 34, a bottom collar 40, a cartridge seal 50, O-rings 52 and a reservoir or tank 60.

Figure 6:
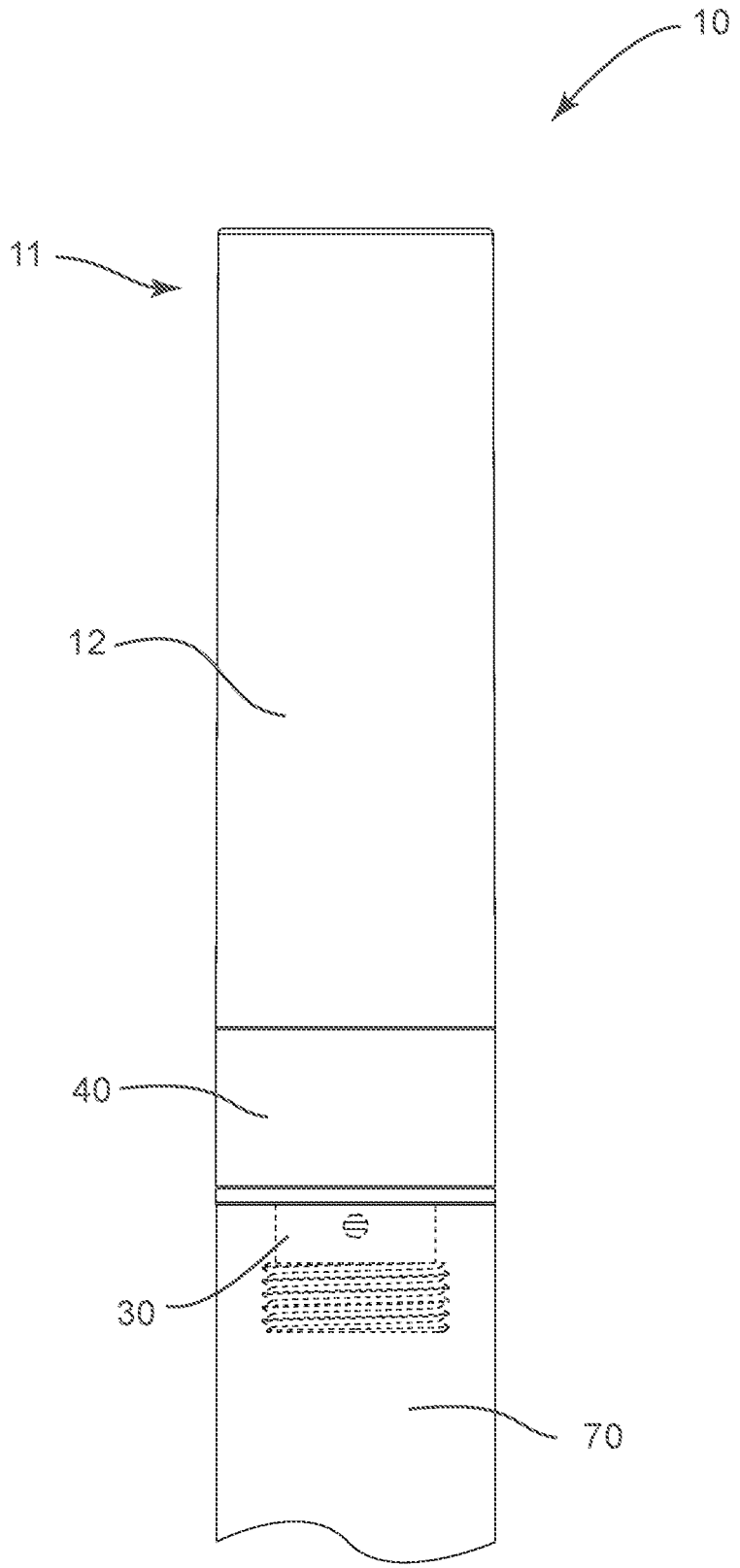
FIG. 6 is a side view of a vape cartridge coupled to a power source in accordance with an embodiment.

The vape cartridge assembly 10 may be assembled such that the contact pin 32 and contact pin seal 34 are coupled through a central aperture of the connector 30. The connector 30 may be press fit into the inner passage 13 of the cartridge body 12 with the bottom collar 40 coupled round the cartridge body 12 and the connector 30 operating to cover the seam formed between the connector 30 and the cartridge body 12. The connector 30 may be coupled to a power source 70 (See FIG. 6).

The atomizer shell 14 may have an inner volume that receives the wick 16 and the coil 18 embedded within the wick 16 and a cotton/cellulose is wrapped around the atomizer for fluid control. The atomizer shell may be coupled adjacent the drip catcher 20 within an end of the connector 30. The vapor tube 15 extends from the inner volume of the atomizer shell 14 and within the inner passage 13 of the cartridge body 12.

The cartridge seal 50 may be coupled within the inner passage 13 of the cartridge body 12, such that the cartridge seal 50 is coupled over an end of the vapor tube 15. The cartridge seal 50 may include a protrusion 54 on one end with a central aperture extending through the cartridge seal 50 and the protrusion 54, wherein the protrusion 54 operates as a guidepost and couples to the vapor tube 15. The protrusion 54 coupled to the vapor tube 15 may include the vapor tube 15 press fit within the protrusion 54. The protrusion 54 operates as a guidepost to ensure proper connection with the vapor tube wherein the guidepost 54 aligns the vapor tube within the guidepost 54 prior to applying pressure to press fit the cartridge seal 50 to couple to the vapor tube 15. The alignment provided by the guidepost 54 reduces common accidental damage that can occur during pressing the cartridge seal 50 onto the vapor tube 15. O-rings 52 may be used to further create a seal between the cartridge seal 50 and the inner wall 19 of cartridge body 12 within the inner passage 13. The cartridge seal 50 may include a channel 56 formed around a perimeter of the cartridge seal 50, wherein the O-ring(s) 52 are coupled within the channel 56 of the cartridge seal 50. The Coupling of the cartridge seal 50 to the vapor tube 15 forms the reservoir 60 bound by the cartridge seal 50 on one end, the connector 30 on the other end, the atomizer shell 14 with vapor tube 15 in an interior and the cartridge body 12 on the exterior. The end of the cartridge body 12 that is opposite the connector 30 operates as the mouthpiece once the seal 50 is coupled within the inner passage 13 and to the vapor tube 15.

The atomizer shell 14 may include at least one aperture 17 that allows fluid stored within the reservoir 60 to enter within the atomizer shell 14 and contact the wick 16. The aperture 17 also allows for flow of air into the reservoir as the atomization of vape fluid retained within the reservoir 60 occurs and thereby the vaporized fluid can thereby be drawn through the vapor tube 15, the cartridge seal 50 and through cartridge body 12 that is also the mouthpiece 11 into the lungs of a user.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A vape cartridge assembly comprising:

a cartridge body with an inner passage;

a connector coupled to an end of the cartridge body for connecting to a power source;

an atomizer within an inner volume of an atomizer shell, the atomizer shell comprising a vapor tube wherein the atomizer shell is coupled to the connector within the inner passage of the cartridge body;

a cartridge seal coupled to the vapor tube of the atomizer shell within the inner passage of the cartridge body to form a fluid reservoir on one side of the cartridge seal and a mouthpiece on the opposite side of the cartridge seal, wherein the mouthpiece is integrally formed with the cartridge body to form a monolithic structure and wherein the atomizer shell is coupled adjacent a drip catcher that is within an end of the connector.

2. The assembly of claim 1, wherein the fluid reservoir is bound by the cartridge seal on one end, the connector on the other end, the atomizer shell with vapor tube in an interior and the cartridge body on an exterior.

3. The assembly of claim 1, wherein the cartridge seal comprises a protrusion with a central passage extending through the cartridge seal and the protrusion.

4. The assembly of claim 3, wherein protrusion of the cartridge seal is coupled to the vapor tube.

5. The assembly of claim 4, wherein the protrusion is press fit over the vapor tube to couple the protrusion to the vapor tube.

6. The assembly of claim 1, further comprising at least one O-ring coupled between the cartridge seal and an inner wall of cartridge body within the inner passage.

7. The assembly of claim 6, wherein the cartridge seal further comprises a channel formed around a perimeter of the cartridge seal, wherein the at least one O-ring is coupled within the channel of the cartridge seal.

8. The assembly of claim 1, wherein the atomizer comprises a wick and a coil embedded within the wick.

9. The assembly of claim 8, further comprising a cotton/cellulose wrapped around the atomizer for fluid control.

10. The assembly of claim 1, wherein the vapor tube extends from the inner volume of the atomizer shell and within the inner passage of the cartridge body.

11. The assembly of claim 10, wherein the atomizer shell comprises at least one aperture, wherein fluid stored within the reservoir enters within the atomizer shell and contacts the wick.

12. The assembly of claim 11, wherein the aperture allows for flow of air into the reservoir as atomization of vape fluid retained within the reservoir occurs and thereby the vaporized fluid be drawn through the vapor tube, the cartridge seal and through cartridge body that is also the mouthpiece.

13. The assembly of claim 1, wherein the connector comprises a contact pin and contact pin seal coupled through a central aperture of the connector.

14. The assembly of claim 13, wherein the connector is press fit into the inner passage of the cartridge body.

15. The assembly of claim 14, further comprising a bottom collar coupled round the cartridge body and the connector operating to cover a seam formed between the connector and the cartridge body.

* * * * *